US006029020A

United States Patent [19]

Blackman et al.

[11] Patent Number: 6,029,020

[45] Date of Patent: Feb. 22, 2000

[54] AUTOMATIC ALIGNMENT OF MEDIA FOR PROPER PRINT SIDE ORIENTATION

[75] Inventors: Jeffrey R. Blackman, Vancouver; Thomas W. Ruhe, La Center, both of Wash.

[73] Assignee: Hewlett-Packard Company, Palo Alto, Calif.

[21] Appl. No.: 09/283,142

[22] Filed: Mar. 31, 1999

[51] Int. Cl.[7] ..... G03G 15/00; G03G 21/00

[52] U.S. Cl. ..... 399/45; 399/13; 399/110; 399/364; 399/389

[58] Field of Search ..... 399/45, 389, 13, 399/85, 107, 110, 364, 401, 9; 271/186, 225, 902; 101/229, 230, 231; 400/636

[56] References Cited

U.S. PATENT DOCUMENTS

| | | | |
|---|---|---|---|
| 3,972,612 | 8/1976 | Komori et al. | 355/26 |
| 4,607,948 | 8/1986 | Naito | 355/24 |
| 4,674,857 | 6/1987 | Satomura et al. | 399/306 |
| 4,777,498 | 10/1988 | Kasamura et al. | 399/401 |
| 4,787,616 | 11/1988 | Sasaki et al. | 271/3.03 |
| 4,845,528 | 7/1989 | Aoki et al. | 399/85 |
| 5,146,087 | 9/1992 | VanDusen | 399/45 X |
| 5,488,456 | 1/1996 | Jamzadeh | 399/45 |
| 5,772,343 | 6/1998 | Beretta et al. | 399/401 X |

OTHER PUBLICATIONS

Hewlett Packard, "LaserJet 4000T Engine with Duplexer Unit," 6 pages; Disclosed Oct. 1997.

*Primary Examiner*—Sophia S. Chen

[57] ABSTRACT

A media sheet is picked and moved along a media path toward a print zone. During the operation a media sensor detects whether the media sheet is properly oriented to receive print recording. For example, for glossy paper, photographic paper or letterhead there is a proper side of the paper for recording and a backside of the paper which typically does not receive print recording. If the proper side is not oriented to receiving print recording, then the media sheet is flipped by a modular duplex media handling system.

12 Claims, 5 Drawing Sheets

AUTOMATIC ALIGNMENT OF MEDIA FOR PROPER PRINT SIDE ORIENTATION

BACKGROUND OF THE INVENTION

This invention relates generally to a method for handling a media sheet in a print recording system, and more particularly to a method for flipping a media sheet in a print recording system.

Print recording systems are referred to as either simplex systems or duplex systems. A simplex system prints to one side of a media sheet. A duplex system prints to both sides of a media sheet, either printing to both sides in parallel or in series to one side then another side. Duplex printing typically is accomplished by either one of two methods. In one method, sheets oriented for first side printing are stacked in a duplex tray. When first side printing is complete for the set, the sheets are fed out of the duplex tray and returned with an odd number of inversions along a duplex path to receive second side print recording. In an alternative method the sheets with first side printing are returned directly to receive second side printing without stacking. Simplex printing is accomplished by feeding a media sheet along a one-way media path to receive print recording.

SUMMARY OF THE INVENTION

According to the invention, during a simplex printing operation a media sheet is flipped to print on a reverse side, rather than an initially face-up side. According to one aspect of the invention, a media sheet is picked and moved along a media path toward a print zone. During the operation a media sensor detects whether the media sheet is properly oriented to receive print recording. For example, for glossy paper, photographic paper, transparencies and letterhead there is a proper side of the paper for recording and a backside of the paper which typically does not receive print recording.

According to another aspect of the invention, the media sheet is flipped to receive print recording on the proper side. For example, an operator may load the paper upside down in an input tray. Rather than print to the wrong side, or refuse to print, the media sheet is flipped. One advantage of this process is that paper is saved (as it is assumed that printing to the improper side results in discarding the media sheet). Another advantage is that printing is more convenient to the operator because delays are avoided for reloading the paper properly.

According to another aspect of the invention, a modular duplex media handling system is used in conjunction with a simplex media handling print recording apparatus and a media sensor. The simplex media handling system includes firmware for operating either in a simplex mode or in a duplex mode, (where the modular duplex media handling system is installed to operate in duplex mode).

The host print recording system includes the simplex media handling system and a recording print source. The simplex media handling system includes feed rollers and metering rollers. A media sheet is fed from an input tray along a first media path from the feed rollers to the metering rollers, onward into a print zone adjacent to the print recording source. A media sensor detects whether the media sheet is properly oriented. If properly oriented, then the media sheet is fed through the print zone to receive print recording. The media sheet continues into an output tray.

According to another aspect of the invention, if the media sheet is improperly oriented, the media sheet still is fed along the first media path. The media sheet is fed passed a position sensor flag, and may enter into the print zone. However, print recording does not occur. Before the trail edge of the media sheet enters the print zone, the metering roller stops with the media sheet being grasped by the metering roller. This occurs prior to releasing the media sheet into the output tray. While the metering roller still engages the media sheet, the metering roller reverses direction to move the media sheet back along the first media path onto the feed roller. The feed roller, rotating with the metering rollers in the reverse direction, moves the media sheet into the modular duplex handling system. The media sheet is flipped by the modular duplex handling system, which feeds the media sheet back to the feed roller. The feed roller rotating once again in the forward direction moves the flipped media sheet along the first paper path to the metering roller and into the print zone. The flipped media sheet is fed through the print zone for print recording to the proper side of the media sheet and released into the output tray.

One advantage of the invention is that automatic media flipping is accomplished without user intervention. These and other aspects and advantages of the invention will be better understood by reference to the following detailed description taken in conjunction with the accompanying drawings.

DESCRIPTION OF SPECIFIC EMBODIMENTS

Overview of Print Recording System

Figure 1:
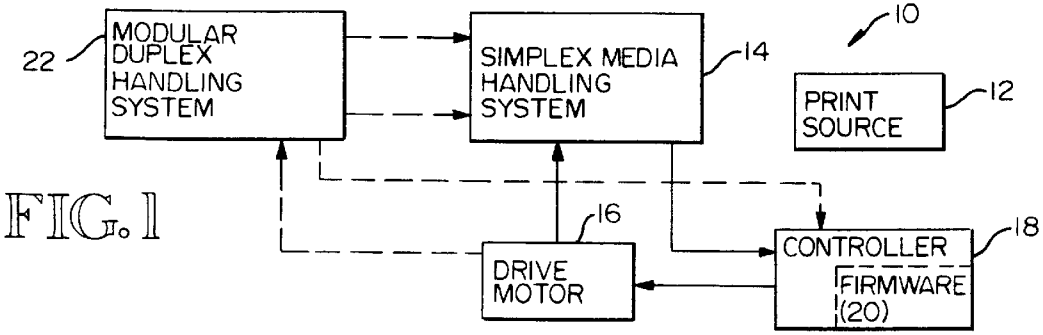
FIG. 1 is a block diagram of a print recording system according to an embodiment of this invention.

Referring to FIG. 1, a print recording system 10 includes a print source 12, a simplex media handling system 14, a drive motor 16 and a controller 18 with firmware 20. Also included in the system 10 is a modular duplex media handling system 22. The duplex media handling system 22 is removable, allowing the system 10 to be customized for simplex printing models and duplex printing models.

Figure 2:
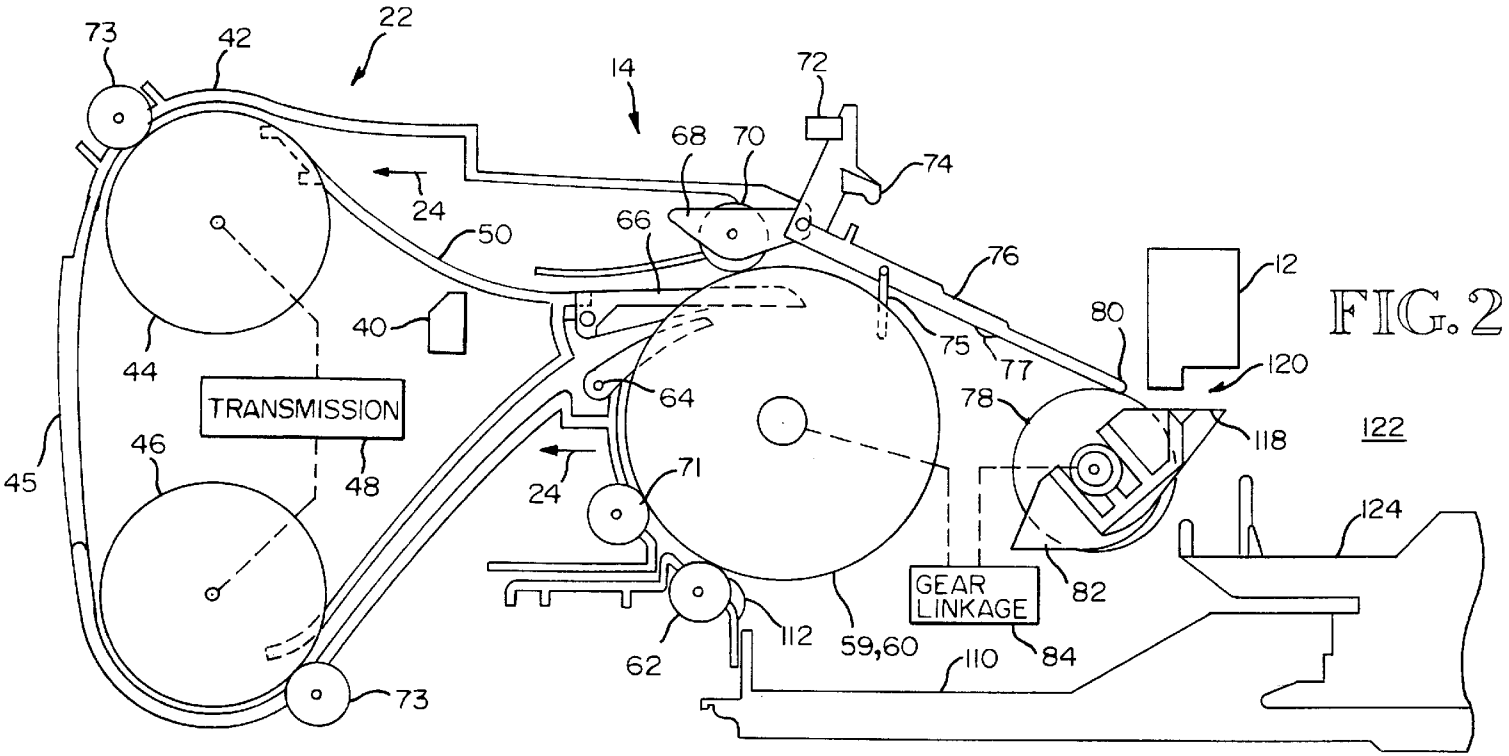
FIG. 2 is a planar view of a portion of the simplex media handling system and modular duplex handling system of FIG. 1 according to an embodiment of this invention.
Figure 3:
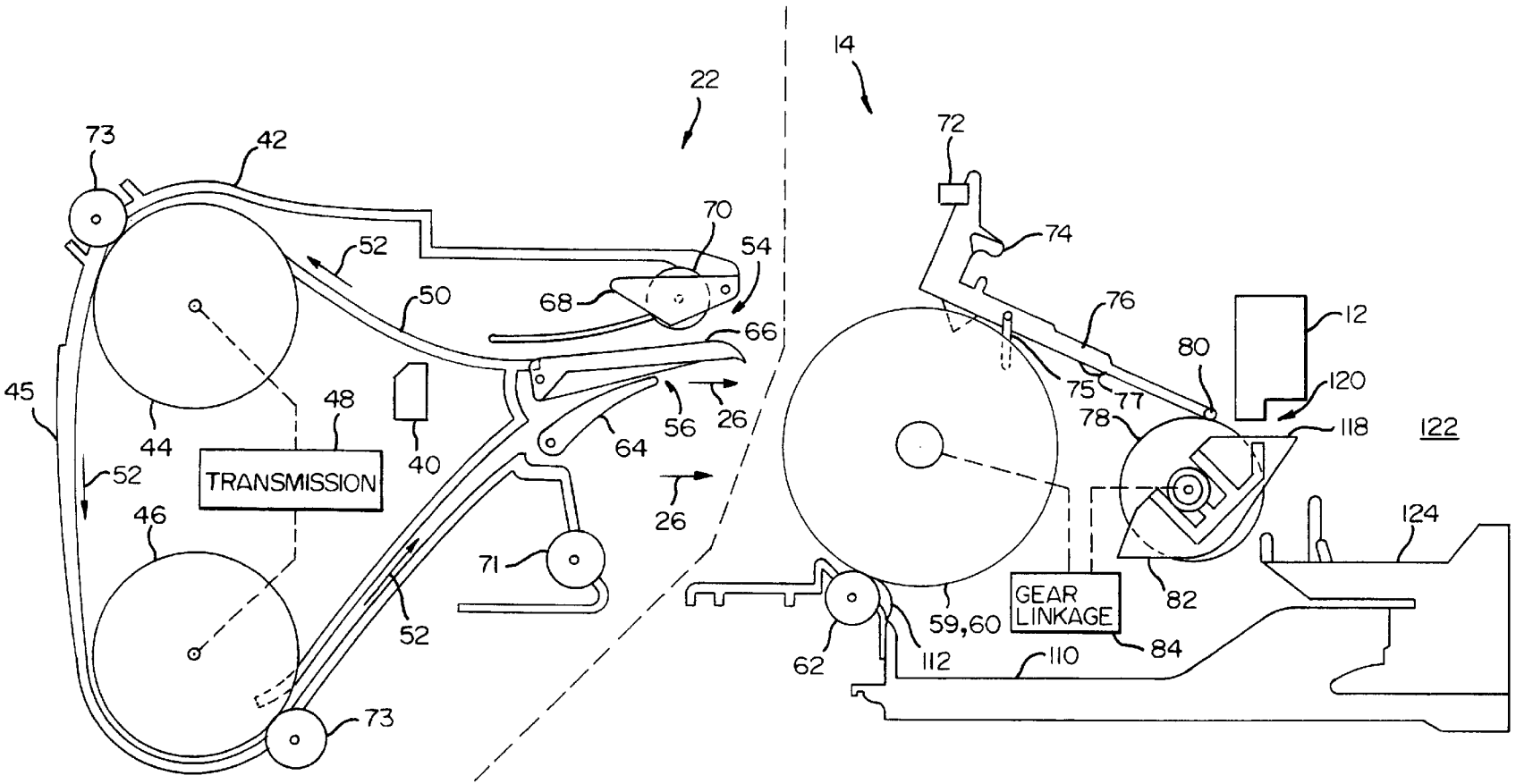
FIG. 3 is an exploded planar view of the duplex handling system separated from the simplex handling system of FIG. 2 according to an embodiment of this invention.

Referring to FIG. 2, the print source 12, simplex media handling system 14 and duplex media handling system 22 are shown for an inkjet printer embodiment. FIG. 3 shows the same structure with the duplex handling system 22 detached. The duplex media handling system 22 is easily removed by sliding the module 22 in direction 24 (see FIG. 2), then lifting the module away from the simplex media handling system 14. The duplex media handling system 22 is installed by removing a rear access door, then lowering the system 22 into a housing for the print recording system 10. The duplex media handling system 22 then is slid in direction 26 (see FIG. 3) toward the simplex media handling system 14. The duplex media handling system 22 engages to the simplex media handling system 14 using the same mechanical interface as was used for the removed rear access door.

The duplex media handling system 22 includes a sensor 40 which interfaces with the controller 18, allowing the controller 18 to detect whether the duplex media handling system 22 is present in the print recording system 10. An electrical, electromechanical and/or electro-optical connection is included to interface the sensor 40 output with the controller 18. The controller 18 tests to determine whether the duplex media handling system 22 is installed. Specifically, if a sensor 40 signal is present, then the system 22 is installed (since the sensor is part of the system 22). In response, the controller 18 firmware 20 enables both simplex printing and duplex printing operations. If a sensor 40 signal is not present, then the controller 18 firmware 20 disables duplex printing operations and allows simplex printing operations.

In operation the print recording system 10 receives a media sheet upon which text, graphics or other symbols are to be recorded. For example, in an inkjet printer embodiment the printer receives a print job from a host computer (not shown). The controller 18 controls the drive motor 16 and print source 12 coordinating the movement of the media sheet relative to the print source 12. For single-sided (i.e., simplex) printing, the media sheet is fed through the simplex media handling system 14 adjacent to the print source 12 where the text, graphics or other symbols are recorded on the media sheet. For duplex printing, the media sheet is fed through the simplex media handling system 14 along a media path to perform first-side printing. The media sheet then is fed back along a portion of the media path into the duplex handling system 22 which flips the media sheet, then returns the media sheet to the simplex media handling system 14 for second side printing.

Referring to FIG. 3, the duplex media handling system 22 includes the sensor 40, a frame 42, panel 45, a pair of drive rollers 44, 46, a transmission 48, flip guides 64, 66, pinch rollers 70, 71, 73, and roller sleds 68. The transmission 48 is coupled to the print recording system's drive motor 16. During duplex printing, a media sheet is fed within the duplex media handling system 22 along a loop media path 52. The media sheet is received at flip guide 66 and fed by the simplex media handling system 14 along a paper guide 50 of the frame 42 toward the first drive roller 44. The drive roller 44 moves the media sheet along the path 52 to the second drive roller 46, which in turn, moves the media sheet out of the modular duplex handling system 22 back to the simplex media handling system 14. The duplex module media path 52 is a loop having an entry point 54 in the vicinity of the exit point 56. Both the entry point 54 and the exit point 56 are adjacent to a common area of the simplex media handling system 14.

Referring to FIGS. 2 and 3, the simplex media handling system 14 includes pick roller 59, feed rollers 60, feed idlers 62, media sensors 72, 77, flag 74, secondary flag 75, an upper guide 76, and metering rollers 78 with another set of pinch rollers 80, a pivot mechanism 82 and gear linkage 84. The drive motor 16 (see FIG. 1) is coupled to the feed rollers 60 and metering rollers 78 through the gear linkage 84. An opening is included for receiving the duplex media handling system 22.

Figure 4:
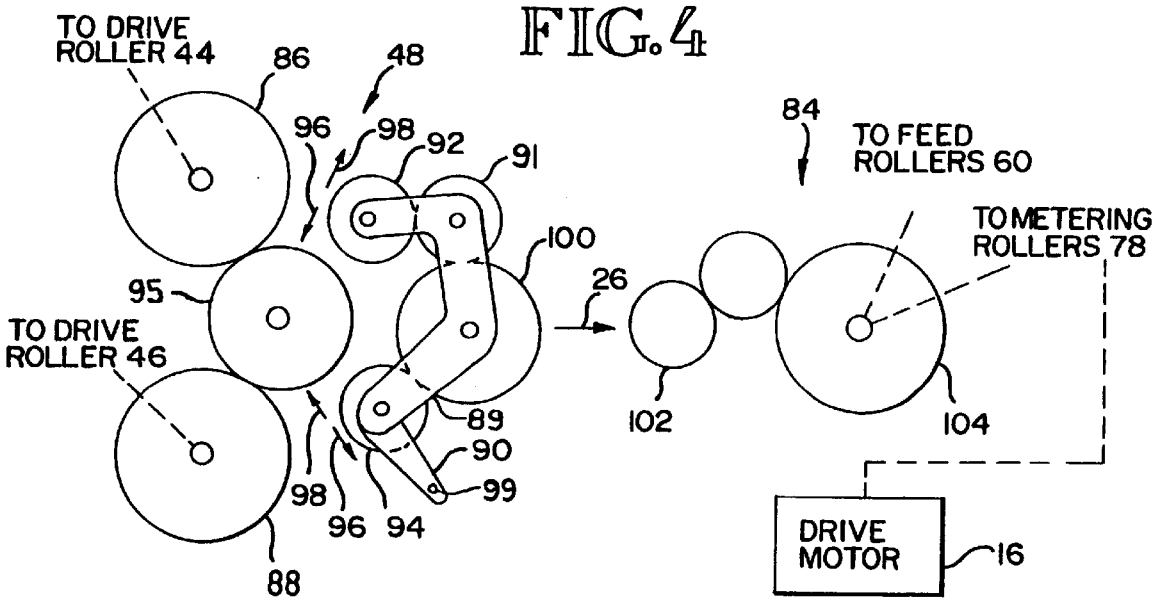
FIG. 4 is a diagram of the duplex media handling system transmission and the simplex media handling system gear linkage of FIG. 3 according to one embodiment of this invention.

Referring to FIG. 4, the gear linkage 84 of the simplex media handling system 14 is coupled to the transmission 48 of the duplex media handling system. The transmission 48 and gear linkage 84 couple the drive rollers 44, 46 to the drive motor 16. The transmission 48 includes a first drive gear 86 for the first drive roller 44 and a second drive gear 88 for the second drive roller 46. Through a subset of gears 86, 88, 91,92, 94, 95, and 100, the transmission 48 engages the drive rollers 44, 46.

Gear 100 serves as a coupling gear which links the transmission 48 to the gear linkage 84 of the simplex media handling system (e.g., at gear 102). Gear 100 is driven by the drive motor 16 through the gear linkage 84. Transmission gears 91, 92, and 94 are coupled to gear 100, and are mounted to a gear mount 89. The rotation of gear 100 causes the gears 91, 92 and 94 and gear mount 89 to move about the gear 100 in one of two directions 96, 98. Movement of the gears 91, 92, 94 in direction 96 brings gear 92 into engagement with gear 95, and gear 94 out of engagement with gear 95, causing drive gears 86, 88 to rotate in the opposite direction. In this engagement of gears 92 and 95, the transmission 48 is considered to be in first gear. Movement of the gears 91,92, 94 in direction 98 brings gear 94 into engagement with gear 95, and gear 92 out of engagement with gear 95, causing drive gears 86, 88 to rotate in one direction. In this engagement of gears 94 and 95, the transmission 48 is considered to be in second gear. In first gear, the drive rollers 44, 46 rotate in the same direction as the feed rollers 60 and metering rollers 78 of the simplex media handling system. In second gear, the drive rollers 44, 46 rotate in the opposite direction as the feed rollers 60 and metering rollers 78 of the simplex media handling system.

When the duplex media handling system is installed, gear 100 engages the gear linkage 84 of the simplex media handling system 14 at an interface gear 102. Gear linkage 84 also includes a drive gear 104 which is coupled to the drive motor 16 through a linkage included to drive the feed rollers 60 and metering rollers 78.

The transmission 48 also includes a clutch 90 which is coupled at one end to gear 94. The other end of the clutch 90 includes a protrusion 99 which moves within a cam track (not shown). When the transmission 48 is in neutral, the protrusion 99 sits in a fixed location (e.g., a V-lock groove) of the cam track. It takes a change of direction of gear 100 to move the protrusion out of the V-lock. A gear change (one of gears 92, 94 engaging gear 95) may then occur. Note that the clutch 90 moves with gear 94 in the directions 96,98. When gear 92 is engaged or gear 94 is engaged, the protrusion 99 does not come to rest in the V-lock. It is when the transmission 48 is in neutral, that the protrusion 99 sits in the V-lock.

To switch gears from engagement of gear 94 with gear 95 to neutral (the position illustrated in FIG. 4), the drive motor 16 stops driving gear 100, then restarts driving gear 100 in the opposite direction. This moves the gear 94 in direction 96 and brings the clutch 90 to rest in neutral (protrusion 99 sits in the V-lock). This is referred to as a stop and start action. To continue on switching gears to bring gear 92 into engagement with gear 95, the direction of gear 100 is changed again to allow the clutch 90 to come out of neutral, then the direction is changed one more time to move the gears 92, 94 and clutch 90 further along in direction 96. This brings gear 92 into engagement with gear 95. The actions to switch from neutral to engagement of gear 92 (or gear 94) with gear 95 is called a jogging action.

In a preferred embodiment the feed rollers 60 and metering rollers 78 are driven in a common direction during simplex or duplex media handling. That common direction changes during duplex printing, but is the same for the feed rollers 60 and metering rollers 78. Depending on the position of gears 92, 94, the drive rollers 44, 46, while engaged, rotate in either the same direction as the feed rollers 60/metering rollers 78 or in the opposite direction as the feed rollers 60/metering rollers 78. While the drive rollers 44,46 are engaged, one drive roller 44/46 always rotates in the same direction as the other drive roller 46/44. The specific gear linkages for the transmission 48 and linkage 84 may vary depending on the specific embodiment. For example the relative positioning and size of the simplex media handling system 14 and duplex media handling system 22 may vary, resulting in differing transmission 48 and linkage 84 embodiments.

Proper Media Side Orientation During Simplex Printing

Figure 5:
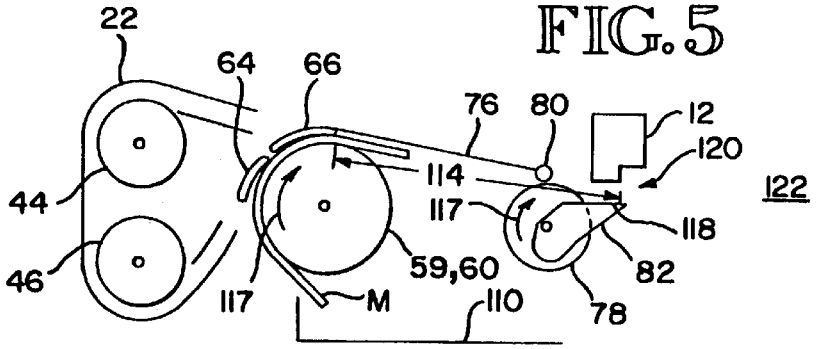
FIG. 5 is a diagram of the duplex media handling system and simplex media handing system during the pick and feed of a media sheet.

The media handling operations are described with regard to FIGS. 5–10. A media sheet M is lifted into contact with a pick roller 59. The top sheet M is picked from a stack of media sheets in an input tray 110. Excess sheets are retarded by a restraint pad system 112 (see FIG. 2, 3). Referring to FIGS. 2 and 5 the picked media sheet M is fed around feed rollers 60. The feed idlers 62 and pinch rollers 70, 71 press the media sheet to the feed rollers 60. The media sheet pushes the flip guides 64, 66 out of the media path as the media sheet moves along the feed rollers 60. Beyond the flip guides 64, 66 the media sheet moves along a first media path 114. The media path 114 spans a path from rollers sleds 68/pinch rollers 70 to the metering rollers 78 and into a print zone 120. The media sheet is moved between the feed rollers 60 and the roller sleds 68/pinch rollers 70, under the upper guide 76 and onto the metering rollers 78. Pinch rollers 80 press the media sheet to the metering rollers 78. Both the metering rollers 78 and the feed rollers 60 are moving in a forward direction 117 during the first side printing operation. Eventually a trailing edge of the media sheet M passes beyond the feed rollers 60 so that the metering rollers 78 move the media sheet. Beyond the pinch rollers 80, the media sheet is moved along a platform 118 of the pivot mechanism 82. The print source 12 is located adjacent to the platform 118. The area between the platform 118 and the print source 12 is referred to herein as the print zone 120.

For a select simplex mode of operation, a media orientation detection capability is active. During such mode, the media sheet is sensed by an optical sensor 77 to determine whether the proper side of the media sheet is oriented to receive the print recording. In various embodiments the sensor 77 is located on a carriage which carries the print cartridge 12, near the media restraint pad 112 or along the paper guide 76. If inactive, the media sheet M is fed along the first path into the print zone for simplex printing to the current side of the media sheet. The media sheet M is fed through the print zone 120 into an output region 122, which in some embodiments includes an output tray 124. Also, if active and if properly oriented, the media sheet M is fed along the first path into the print zone for simplex printing to the current side of the media sheet. For normal simplex printing, the media sheet is released into the output region 122. Immediately or after a suitable drying time (depending on the type of print source), another media sheet may be picked and fed along the media path through the print zone for print recording.

If the media orientation detect capability is active and the proper side is not detected, then the media sheet is flipped before receiving print recording. Proper orientation of the media sheet is detected by the sensor 77. In one embodiment the sensor 77 detects whether the side of the media sheet oriented to receive print recording has a reflective coating. In an alternative embodiment the sensor is instead positioned to sense the coating of the opposite side of the media sheet. For such alternative embodiment, if the side which does not receive print recording is reflective, then the media sheet is to be flipped. In another embodiment the media sheet includes a bar code or some other indicia which identifies one side (i.e., face) of the media sheet from the opposite side (i.e., face) of the media sheet. For example, stationery letterhead may be detected or not detected to serve as an indicator of which side is to receive print recording. Various indicia may be used, including but not limited to bar codes, symbols, text, reflectivity, or lack of reflectivity.

If a media sheet is to be flipped, the media sheet does not receive print recording on the current side of the media sheet. Accordingly, the detection and analysis for proper orientation is completed before the leading edge of the media sheet enters into the print zone. In an alternative embodiment the detection and analysis for proper orientation is completed before the media sheet advances beyond the margin distance into the print zone.

To flip the media sheet, the media sheet continues to be fed into the print zone, although print recording does not occur. At some point during the feeding process, a trailing edge of the media sheet M passes beyond the feed rollers 60 so that the metering rollers 78 move the media sheet. Any time after the media sheet M clears the flip guides 64, 66 or the feed rollers 60, the media sheet motion can be stopped and reversed. Such motion is stopped before the media sheet is released into the output region.

Figure 6:
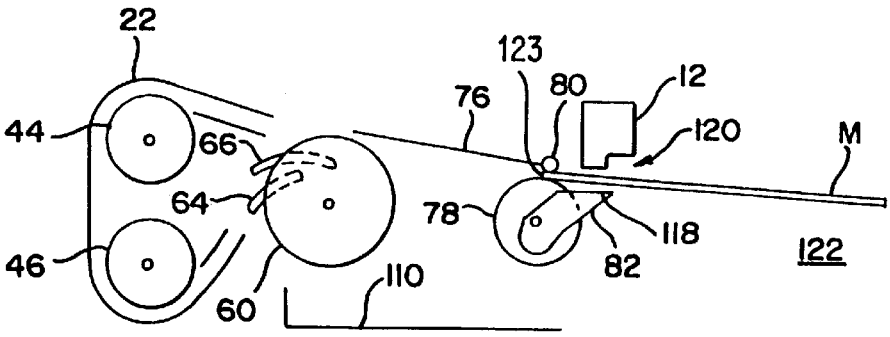
FIG. 6 is a diagram of the duplex media handling system and simplex media handing system at the completion of first side printing where the rollers are stopped with the media sheet trailing edge gripped by the metering rollers.

In a specific embodiment, the media sheet is fed along the first media path 114 into the print zone. Once the trailing edge of the media sheet reaches the metering roller, the forward advancement of the media sheet stops. Referring to FIG. 6, while the pinch roller 80 presses the trailing edge 123 of the media sheet M to the metering roller 78, the motion of the feed rollers 60 and metering rollers 78 ceases. The drive motor 16 then reverses the rotational direction of the feed rollers 60 and metering rollers 78 to a direction 121 (see FIG. 7).

Figure 7:
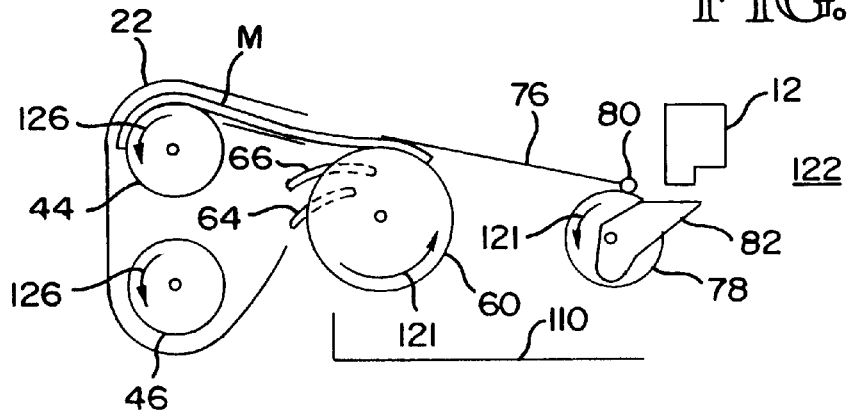
FIG. 7 is a diagram of the duplex media handling system and simplex media handing system where the media sheet is being fed back along the media path into the duplex media handling system.

Referring to FIG. 7, the metering rollers 78 feed the media sheet M back along the first media path 114 into contact with the feed rollers 60. The feed rollers 60 then continue feeding the media sheet back. Eventually the media sheet M is out of the grasp of the metering rollers 78 and fed back only by the feed rollers 60 (as distinguished from both the feed rollers 60 and metering rollers 78). As the media sheet M is fed back to and then onto the feed roller the flip guides 64, 66 are positioned in their unbiased position (see position in FIGS. 2 and 3). The unbiased position has the flip guides blocking the path around the feed rollers 60 back toward the input tray 110. Instead, the media sheet M is fed over a support surface of the flip guide 66 into the duplex media handling system module 22. The feed rollers 60 feed the media sheet M toward and onto the first drive roller 44. At the time where the controller 18 had the drive motor 16 reverse the directions of feed rollers 60 and metering rollers 78 to direction 121, such reversal action causes the transmission 48 to enter second gear (i.e., second gear 94 engages gear 95, see FIG. 4). As a result, when the media sheet is fed from the feed rollers 60 to the drive roller 44, the drive rollers 44, 46 are rotating in a direction 126. The drive roller 44 feeds the media sheet to drive roller 46. The drive rollers 44, 46, and then drive roller 46 alone feeds the media sheet along path 52 (see FIG. 3) back toward the feed rollers 60.

The duplex media handling system 22 has a media path length from entry point 54 to exit point 56 (see FIG. 3) which is at least as long as the maximum rated media sheet length for automatic duplex handling (e.g., 11 inches; 14 inches; 17 inches). If, however, automatic duplex handling is limited to a specific size, such as 11 inches or A4 paper length, then simplex printing (and manual duplex printing) may still print to larger sheets (e.g., 14 inches; 17 inches). Prior to the time the media sheet is fed out of the duplex media handling system 22 back onto the feed rollers 60, the feed rollers 60 are to change direction from reverse direction 121 back to the forward direction 117. However, the direction through the duplex media handling system module should stay the same (i.e., direction 126) even when the feed rollers 60 go back to the forward rotational direction 117. The forward rotational direction as used herein refers to the direction 117 which the feed rollers 60 rotate to move the media sheet from the feed rollers 60 to the metering rollers 78 along the first media path 114.

Figure 8:
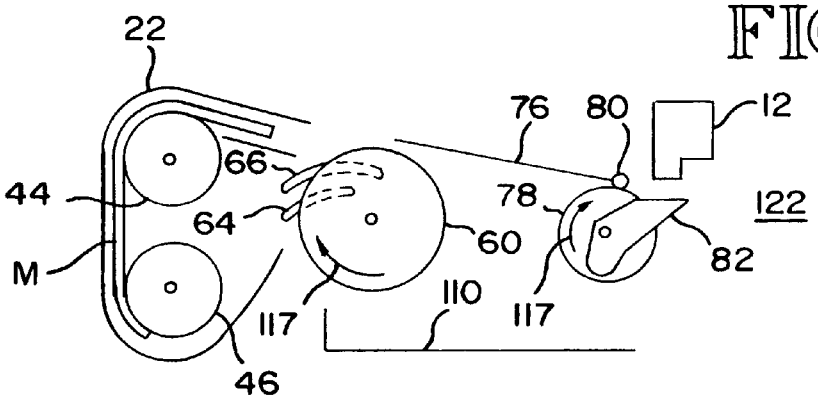
FIG. 8 is a diagram of the duplex media handling system and simplex media handing system where the media sheet is completely within the duplex media handling system and the feed rollers have reversed direction putting the transmission in neutral.
Figure 9:
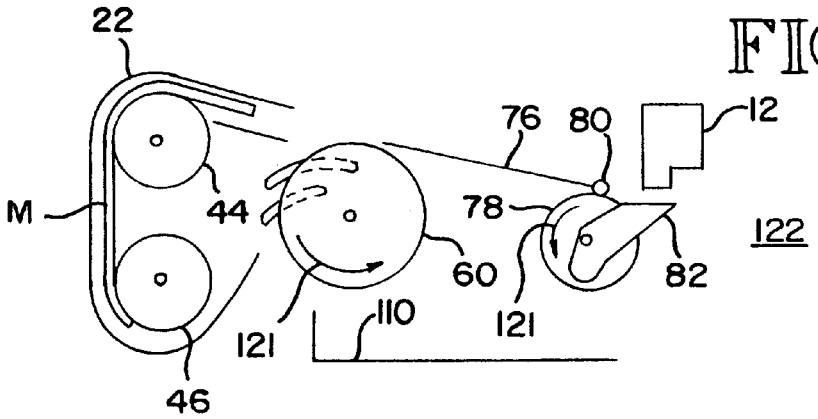
FIG. 9 is a diagram of the duplex media handling system and simplex media handing system during a jogging operation of the duplex media handling system transmission.

The process to change directions of the feed rollers 60 back to the forward direction 117, while the media sheet is in the duplex handling system 22, is now described. As the media sheet M is fed back along the first media path 114 from the metering rollers 78 to the feed rollers 60 (FIG. 7), the media sheet trips the secondary flag 75 which trips the flag 74 (see FIG. 3). The flag 74 is tripped, then released, as the entire media sheet passes beyond the flags 74, 75. A sensor 72 coupled to the flag 74 outputs such tripping indications to the controller 18. The controller knows what direction the drive motor 16 is rotating the rollers 60, 78, and thus knows that the media sheet is being fed back for duplex printing. Thus, the controller 18 knows what signification to give to the trippings of the flags 74, 75. Once the media sheet M has passed completely beyond the flag 75, the controller 18 waits a prescribed time (based upon path length and feed speed) until the media sheet is off the feed rollers 60 and is driven/fed only by the drive rollers 44 (or both drive roller sets 44,46). In particular, the controller 18 waits until the media sheet is a prescribed distance beyond the feed roller into the duplex media handling system 22. At such time, the controller 18 signals the drive motor 16 to change the rotational direction of the feed rollers 60 and metering rollers 78 back to the original forward direction 117. FIG. 8 shows the media sheet M in the duplex media handling system 22 with the feed rollers 60 restarted in the opposite direction. This stopping and starting action of the feed rollers 60 (and metering rollers 78) moves the clutch 90 (see FIG. 4) causing the second gear 94 to come out of mesh. Specifically, the stopping and starting action puts the transmission 48 into neutral.

To shift the transmission 48 out of neutral, and more particularly to engage the first gear 92, rather than the second gear 94, a jogging action is performed. Shortly after the drive motor changes the direction of the feed rollers 60 back to the forward direction 117, the drive motor 16 changes the direction again back to the reverse direction 121 (see FIG. 9), then forward again to direction 117 (see FIG. 10). This operation is referred to herein as a jogging action. Such jogging action causes the clutch 90 to engage the first gear 92 with gear 95 (see FIG. 4). With the first gear engaged while the feed rollers 60 rotate in the forward direction, the drive rollers 44, 46 rotate in the desired direction 126 (see FIG. 10).

With the feed rollers 60 and metering rollers 78 rotating in direction 117 while the drive rollers 44, 46 rotating in direction 126, the media sheet M is fed out of the duplex media handling system 22 back onto the feed rollers 60. A lead edge of the media sheet moves the flip guide 66 out of its path as the media sheet exits the duplex media handling system 22, allowing the media sheet to be grasped by the feed rollers 60 and moved back onto the first media path 114 (see FIG. 10 and FIG. 5 for first media path 114). The media sheet M goes over the flip guide 64 and under the flip guide 66. The media sheet M is fed along the first media path 114 under the upper guide 76 for top of form sensing with sensor 72 and flags 74, 75, and onto the metering rollers 78, the platform 118 and into the print zone 120 for print recording onto the now, properly oriented media sheet. The media sheet M is fed through the print zone 120 into the output region 122. The media sheet then is released into the output region 122. Immediately or after a suitable drying time (depending on the type of print source), another media sheet may be picked and fed along the media path through the print zone for print recording.

Figure 11A:
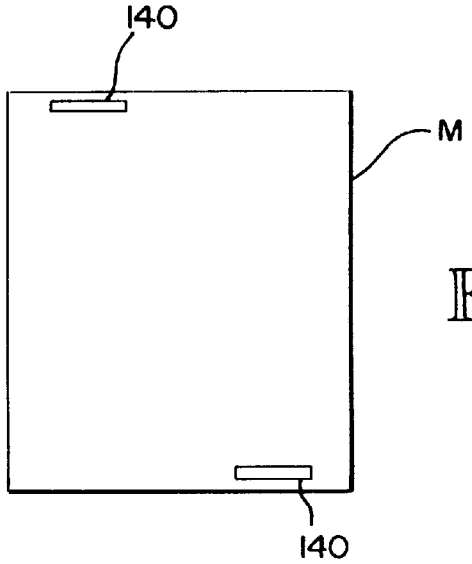
FIGS. 11*a–c* are diagrams of a media sheet having various indicia embodiments for distinguishing one side of the media sheet from an opposite side of the media sheet.
Figure 11B:
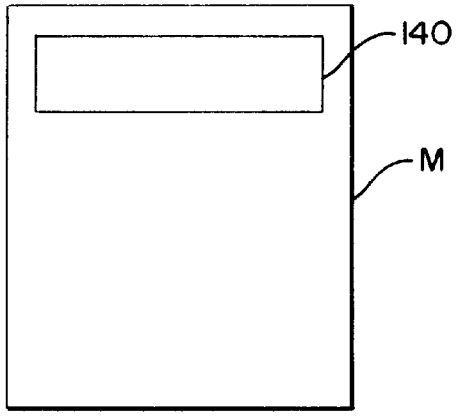
Figure 11C:
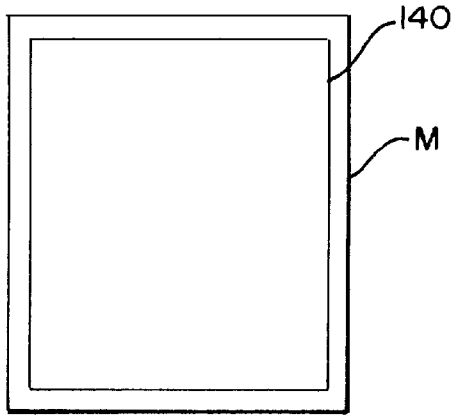

Referring to FIGS. 11*a–c*, a media sheet M includes indicia 140. The indicia serves to identify sides (i.e, faces) of the media sheet. The indicia 140 in various embodiments is a bar code, a symbol or set of symbols, or text. The indicia also may be embodied by the coating, reflectivity, or lack of reflectivity of a given side of the media sheet. Preferably, the indicia as shown in FIG. 11*a* is located along both a leading edge and a trailing edge of the media sheet. One indicia may be located at the leading edge, while a copy of the same indicia is located at the trailing edge. Such symmetry is desired so that the media sheets can be loaded in any manner. A bar code or other symbol or text code is implemented in such manner. In some embodiments the indicia is present on both sides. For example, the relative position of the indicia, rather than the content of the indica, can identify which side is oriented for printing. This is achieved by positioning the indicia at different relative positions on each side of the media sheet. The content of the indicia also can identify which side is oriented for printing.

In some embodiments, such as for a text embodiment which is letterhead, the indicia need not be repeated in various locations or be symmetrically positioned (see FIG. 11*b*). For embodiments in which qualities of one side of the paper versus the other are used as the indicia (e.g., reflectivity, lack of reflectivity), the indicia embodies all or a substantial portion of the media sheet, as shown in FIG. 11*c*.

Duplex Printing

For a duplex printing operation, the first side of the media sheet is printed as described above for the normal simplex mode of printing. However, for duplex printing the trailing edge 123 of the media sheet M is not released during the first-side printing. Thus, the media sheet is not released into the output tray. Referring to FIG. 6, while the pinch roller 80 presses the trailing edge 123 of the media sheet M to the metering roller 78, the motion of the feed rollers 60 and metering rollers 78 ceases. A suitable drying time is allowed before the drive motor 16 reverses the rotational direction of the feed rollers 60 and metering rollers 78 to a direction 121 (see FIG. 7). The sensor 40, which also serves to indicate whether the duplex media handling system is installed, in one embodiment for an wet ink print recording system (e.g., inkjet print recording) is a humidity sensor. The sensor 40 detects the ambient humidity. Controller 18 in response to the detected humidity determines a sufficient drying time before allowing the media sheet to be moved for second side printing. In alternative embodiments separate sensors are used to determine humidity and whether the duplex media handling system is installed. In other embodiments, a sensor is not included for detecting drying time (e.g., non-wet ink printing; a worst case, or even a typical case, drying time is programmed in without sensory indication). Regardless of the sensor 40 embodiment, the controller 18 includes firmware programmed to handle simplex printing or duplex printing. The sensor 40 indication of whether the duplex media handling system is installed or not installed is used by the firmware to determine whether the duplex mode is available.

The determination of when to stop the metering rollers 78 with the media sheet trailing edge grasped is now described. The simplex media handling system 14 includes media sensor 72, flag 74, and secondary flag 75 (see FIGS. 2 and 3). When the media sheet M is moved along the first media path 114 from the feed rollers 60 toward the metering rollers 78, the lead edge of the media sheet trips the secondary flag 75 which trips the flag 74 (see FIG. 3). The flag 74 is tripped, then released, as the entire media sheet passes beyond the flags 74, 75. Sensor 72 coupled to the flag 74 indicates when the leading edge and trailing edge of the media sheet M have passed the flag 75. These indications are detected by the controller 18 which then determines when the trailing edge 123 of the media sheet M is at the pinch roller 80. At such time the controller 18 has the drive motor 16 discontinue rotation of the feed rollers 60 and metering rollers 78. After a programmed pause (e.g., to allow for first side drying), the controller 18, then signals to the drive motor 16 to reverse the rotational directions of the feed rollers 60 and metering rollers 78 to the reverse direction 121.

Referring to FIG. 7, the metering rollers 78 feed the media sheet M back along the first media path 114 into contact with the feed rollers 60. The feed rollers 60 then continue feeding the media sheet back. Eventually the media sheet M is out of the grasp of the metering rollers 78 and fed back only by the feed rollers 60 (as distinguished from both the feed rollers 60 and metering rollers 78). As the media sheet M is fed back to and then onto the feed roller the flip guides 64, 66 are positioned in their unbiased position (see position in FIGS. 2 and 3). The unbiased position has the flip guides blocking the path around the feed rollers 60 back toward the input tray 110. Instead, the media sheet M is fed over a support surface of the flip guide 66 into the duplex media handling system module 22. The feed rollers 60 feed the media sheet M toward and onto the first drive roller 44. At the time where the controller 18 had the drive motor 16 reverse the directions of feed rollers 60 and metering rollers 78 to direction 121,such reversal action causes the transmission 48 to enter second gear (i.e., second gear 94 engages gear 95, see FIG. 4). As a result, when the media sheet is fed from the feed rollers 60 to the drive roller 44, the drive rollers 44, 46 are rotating in a direction 126. The drive roller 44 feeds the media sheet to drive roller 46. The drive rollers 44, 46, and then drive roller 46 alone feeds the media sheet along path 52 (see FIG. 3) back toward the feed rollers 60.

The duplex media handling system 22 has a media path length from entry point 54 to exit point 56 (see FIG. 3) which is at least as long as the maximum rated media sheet length for the recording system 10 (e.g., 11 inches; 14 inches; 17 inches). Prior to the time the media sheet is fed out of the duplex media handling system 22 back onto the feed rollers 60, the feed rollers 60 are to change direction from reverse direction 121 back to the forward direction 117. However, the direction through the duplex media handling system module should stay the same (i.e., direction 126) even when the feed rollers 60 go back to the forward rotational direction 117. The forward rotational direction as used herein refers to the direction 117 which the feed rollers 60 rotate to move the media sheet from the feed rollers 60 to the metering rollers 78 along the first media path 114.

The process to change directions of the feed rollers 60 back to the forward direction 117, while the media sheet is in the duplex handling system 22, is now described. As the media sheet M is fed back along the first media path 114 from the metering rollers 78 to the feed rollers 60 (FIG. 7), the media sheet trips the secondary flag 75 which trips the flag 74 (see FIG. 3). The flag 74 is tripped, then released, as the entire media sheet passes beyond the flags 74, 75. Sensor 72 coupled to the flag 74 indicates when the leading edge and trailing edge of the media sheet M have passed the flag 75. The controller knows what direction the drive motor 16 is rotating the rollers 60, 78, and thus knows that the media sheet is being fed back for duplex printing. Thus, the controller 18 knows what signification to give to the trippings of the flags 74, 75. Once the media sheet M has passed completely beyond the flag 75, the controller 18 waits a prescribed time (based upon path length and feed speed) until the media sheet is off the feed rollers 60 and is driven/fed only by the drive rollers 44 (or both drive roller sets 44,46). In particular, the controller 18 waits until the media sheet is a prescribed distance beyond the pinch roller 70 into the duplex media handling system 22. At such time, the controller 18 signals the drive motor 16 to change the rotational direction of the feed rollers 60 and metering rollers 78 back to the original forward direction 117. FIG. 8 shows the media sheet M in the duplex media handling system 22 with the feed rollers 60 restarted in the opposite direction. This stopping and starting action of the feed rollers 60 (and metering rollers 78) moves the clutch 90 (see FIG. 4) causing the second gear 94 to come out of mesh. Specifically, the stopping and starting action puts the transmission 48 into neutral.

To shift the transmission 48 out of neutral, and more particularly to engage the first gear 92, rather than the second gear 94, a jogging action is performed. Shortly after the drive motor changes the direction of the feed rollers 60 back to the forward direction 117, the drive motor 16 changes the direction again back to the reverse direction 121 (see FIG. 9), then forward again t o direction 117 (see FIG. 10). This operation is referred to herein as a jogging action. Such jogging action causes the clutch 90 to engage the first gear 92 with gear 95 (see FIG. 4). With the first gear engaged while the feed rollers 60 rotate in the forward direction, the drive rollers 44, 46 rotate in the desired direction 126 (see FIG. 10).

The relationship of the transmission 48 to the drive roller directions is summarized below:

(1) When the second gear 94 of transmission 48 is engaged and the feed rollers 60 are rotating in the reverse direction 121, the drive rollers 44, 46 rotate in the desired direction 126 (see FIG. 7).

Figure 10:
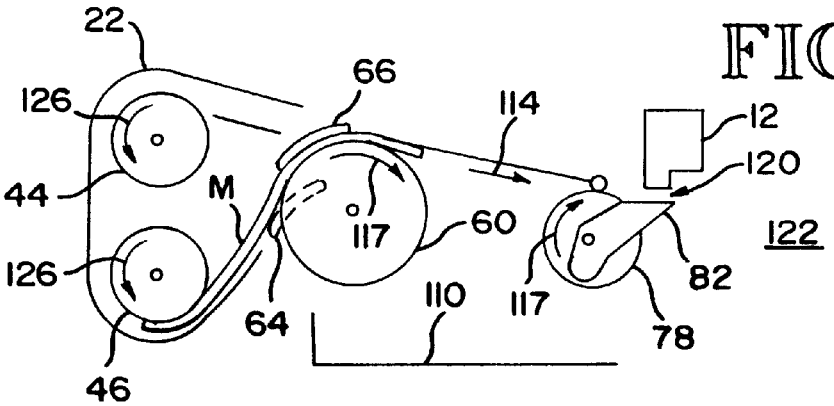
FIG. 10 is a diagram of the duplex media handling system and simplex media handing system during feeding of the media sheet from the duplex media handling system back to the simplex media handling system for second side o r proper print recording.

(2) When the first gear 92 of transmission 48 is engaged and the feed rollers 60 are rotating in the forward direction 117, the drive rollers 44, 46 rotate in the desired direction 126 (see FIG. 10).

Case 1 occurs initially when the media sheet is fed into the duplex media handling system module 22. Case 2 occurs after the jogging action allowing the media sheet M to be fed from the duplex media handling system 22 back onto the feed rollers 60. Case 2 is depicted by FIG. 10.

With the feed rollers 60 and metering rollers 78 rotating in direction 117 while the drive rollers 44, 46 rotating in direction 126, the media sheet M is fed out of the duplex media handling system 22 back onto the feed rollers 60. As a lead edge of the media sheet exits the duplex media handling system 22, such edge moves the flip guide 66 out of its path allowing the media sheet to be grasped by the feed rollers 60 and moved back onto the first media path 114 (see FIG. 10 and FIG. 5 for first media path 114). The media sheet M goes over the flip guide 64 and under the flip guide 66. The media sheet M is fed along the first media path 114 under the upper guide 76 for top of form sensing with sensor 72 and flags 74, 75, and onto the metering rollers 78 and the platform 118, into the print zone 120 for second side print recording. The media sheet M is fed through the print zone 120 into the output region 122. The media sheet then is released into the output region 122. Immediately or after a suitable drying time (depending on the type of print source), another media sheet may be picked and fed along the media path through the print zone for simplex or duplex print recording.

Although the duplex printing operation is described in which the media sheet is picked, receives print on a first side, then flipped to receive print on a second side, an alternative sequence also is implemented. For example, if the first side is not the proper side, then the media sheet is flipped before receiving print recording. The flipped side is printed, then the media sheet is reflipped to receive print recording on the other side.

Meritorious and Advantageous Effects

One advantage of the invention is that media flipping is provided without user intervention or reinsertion. An advantage of the media orientation detection capability is that paper is saved (as it is assumed that printing to the improper side results in discarding the media sheet). Another advantage is that printing is more convenient to the operator because delays are avoided for reloading the paper properly.

Although a preferred embodiment of the invention has been illustrated and described, various alternatives, modifications and equivalents may be used. Therefore, the foregoing description should not be taken as limiting the scope of the inventions which are defined by the appended claims.

What is claimed is:

1. A method for handling a media sheet for print recording, the media sheet having an indicia for distinguishing one side of the media sheet from an opposite side of the media sheet, the method comprising the steps of:

feeding the media sheet, with the media sheet first edge as a leading edge and the media sheet second edge as a trailing edge, along a first media path from a feed roller onto a metering roller toward a print zone;

detecting the indicia of the media sheet;

determining whether a proper side of the media sheet is oriented to receive print recording;

in a case in which the proper side of the media sheet is determined not to be oriented to receive print recording, flipping the media sheet before print recording to the media sheet; and in a case in which the proper side of the media sheet is determined to be oriented to receive print recording, feeding the media sheet through the print zone to receive print recording.

2. The method of claim 1, wherein the step of flipping comprises the steps of:

stopping rotation of the metering roller while the media sheet is gripped by the metering roller;

reversing rotation of the metering roller;

moving the media sheet back along the first media path from the metering roller to the feed roller;

feeding the media sheet from the feed roller onto a set of duplex media handling rollers;

moving the media sheet with the duplex media handling rollers along a loop media path, the media sheet departing contact with the feed roller during movement along the loop media path;

feeding the media sheet from the duplex media handling rollers back onto the feed roller with the media sheet second edge as the leading edge and the media sheet first edge as the trailing edge; and feeding the media sheet along the first media path from the feed roller onto the metering roller and into the print zone for print recording onto the proper side of the media sheet.

3. The method of claim 2, in which the set of duplex media handling rollers are part of a duplex media handling module, the method further comprising, prior to the step of reversing rotation of the metering roller, the step of:

sensing that the duplex media handling module is installed.

4. The method of claim 2, in which the feed roller and the metering roller are linked to rotate in a common forward direction during print recording onto the first side of the media sheet and during print recording onto the second side of the media sheet, and in which the feed roller and the metering roller are linked to rotate in a common reverse direction during the steps of moving the media sheet back along the first media path from the metering roller to the feed roller, and feeding the media sheet from the feed roller onto the set of duplex media handling rollers.

5. The method of claim 2, in which the set of duplex media handling rollers are linked via a transmission to the feed roller, and further comprising, during the step of moving the media sheet with the duplex media handling rollers along the loop media path, the step of:

jogging the rotation of the feed roller from a reverse direction to a forward direction, back to the reverse direction and again to the forward direction while the media sheet is out of contact with the feed roller;

wherein during the step of jogging, the transmission is shifted into neutral to discontinue rotation of the set of duplex media handling rollers, then shifted into gear to rotate the set of duplex media handling rollers and move the media sheet further along the loop path; wherein prior to the step of jogging the feed roller is rotating in the reverse direction while the set of duplex media handling rollers are rotating in a first direction and after the step of jogging the feed roller is rotating in the forward direction while the set of duplex media handling rollers are rotating again in the first direction.

6. A print recording apparatus for recording print onto a media sheet, the media sheet having an indicia for distinguishing one side of the media sheet from an opposite side of the media sheet, comprising:

a print recording source;

a simplex media handling assembly for moving a media sheet along a media path into a print zone adjacent to the print recording source to receive print recording, the simplex media handling assembly comprising a feed roller;

a drive motor for driving rotation of the feed roller;

a removable duplex media handling module interfacing with the simplex media handling assembly to provide a media path for flipping the media sheet;

a sensor for detecting the indicia of the media sheet; and a controller for controlling movement of the media sheet and recording of print onto the media sheet, and for determining whether a proper side of the media sheet is oriented to receive print recording based upon the indicia of the media sheet, wherein when the controller determines from the indicia that the proper side of the media sheet is not oriented to receive print recording, the controller controls the movement of the media sheet within the simplex media handling assembly and the duplex media handling module to achieve flipping of the media sheet before print recording to the media sheet.

7. The print recording apparatus of claim 6, in which the duplex media handling module comprises a sensor having an output interfaced to the controller for indicating presence of the duplex media handling module.

8. The print recording apparatus of claim 7, in which the controller comprises firmware for allowing either one of simplex print recording or duplex print recording while the duplex media handling module sensor indicates presence of duplex media handling module, and for allowing simplex printing and disallowing duplex print recording in the absence of said indication of presence of the duplex media handling module.

9. The apparatus of claim 6, in which the duplex media handling module comprises a set of duplex handling drive rollers and a transmission for coupling the set of duplex handling drive rollers to the drive motor, the transmission having a neutral position, first position and a second position, wherein while the transmission is in the neutral position the set of duplex handling drive rollers are not engaged to rotate; wherein while the transmission is in the first position the set of duplex handling drive rollers are engaged to rotate in the same direction as the feed roller; and wherein while the transmission is in the second position the set of duplex handling drive rollers are engaged to rotate in the opposite direction as the feed roller.

10. The apparatus of claim 9, in which the controller signals the drive motor to change motion of the feed roller and cause the transmission to change positions.

11. The apparatus of claim 10, in which the duplex media handling module includes a loop path for the media sheet, and in which the controller controls the drive motor in a manner which adjusts the position of the transmission to allow the media sheet to travel only in one direction along the loop path.

12. The apparatus of claim 11, in which the loop path has a media sheet entry point and a media sheet exit point at the feed roller.

* * * * *